US006617286B2

(12) United States Patent
Sato et al.

(10) Patent No.: US 6,617,286 B2
(45) Date of Patent: Sep. 9, 2003

(54) LUBRICATING OIL COMPOSITION FOR CONTINUOUSLY VARIABLE TRANSMISSION

(75) Inventors: Takehisa Sato, Chiba (JP); Takanori Kugimiya, Saitama (JP)

(73) Assignee: Tonen General Sekiyu K.K., Saitama (JP)

( * ) Notice: Subject to any disclaimer, the term of this patent is extended or adjusted under 35 U.S.C. 154(b) by 0 days.

(21) Appl. No.: 09/874,883

(22) Filed: Jun. 5, 2001

(65) Prior Publication Data

US 2003/0013619 A1 Jan. 16, 2003

(30) Foreign Application Priority Data

Jun. 5, 2000 (JP) ..... 2000-167144

(51) Int. Cl.[7] ..... C10M 141/06; C10M 139/00
(52) U.S. Cl. ..... 508/192
(58) Field of Search ..... 508/192, 436, 508/442

(56) References Cited

U.S. PATENT DOCUMENTS

| | | | | |
|---|---|---|---|---|
| 5,792,731 A | | 8/1998 | Ichihashi et al. | 508/322 |
| 6,225,266 B1 | * | 1/2001 | Watts et al. | 508/193 |
| 6,184,185 B1 | * | 2/2001 | Taguchi et al. | 508/192 |
| 6,303,546 B1 | * | 10/2001 | Hata et al. | 508/192 |
| 6,337,309 B1 | * | 1/2002 | Watts et al. | 508/291 |

FOREIGN PATENT DOCUMENTS

EP 1183321 * 5/2000

OTHER PUBLICATIONS

Derwent No. 1990–251151 (Japanese Patent Application Laid Open No. Hei 2–175794).

Derwent No. 1997–226197 (Japanese Patent Application Laid Open No. Hei 9–100487) Equivalent to [(a)]JP09 100487..

Derwent No. 1998–126465 (Japanese Patent Application Laid Open No. Hei 10–8081.

Derwent No. 1999–05 4452/05 (Japanese Patent Application Laid Open No. Hei 10–306292).

Derwent No. 1999–267492 Japanese Patent Application Laid Open No. Hei 80772).

Derwent No. 1999–439881, Japanese Patent Application Laid Open No. Hei 181464).

* cited by examiner

*Primary Examiner*—Jacqueline V. Howard
(74) *Attorney, Agent, or Firm*—Linda M. Scuorzo

(57) ABSTRACT

To provide a lubricating oil composition for continuously variable transmission which ensures both a high coefficient of friction between metals required for a push belt-type CTV oil and excellent oxidation stability guaranteeing the performance over a long time.

A lubricating oil composition for continuously variable transmission is provided, which comprises a lubricating base oil made of a mineral oil and/or a synthetic oil formulated with a wear preventive a metal detergent and an ashless dispersant, wherein the ashless dispersant is made of a boron-containing succinimide having boron at a rate of one or more atoms in one molecule of the ashless dispersant.

5 Claims, No Drawings

LUBRICATING OIL COMPOSITION FOR CONTINUOUSLY VARIABLE TRANSMISSION

This application claims priority to Japanese Patent Application No. 167144/00 filed Jun. 5, 2000.

FIELD OF THE INVENTION

This invention relates to a lubricating oil composition for continuously variable transmission, and more particularly, to a lubricating oil composition used in a push belt type of continuously variable transmission. More specifically, the invention relates to a lubricating oil composition which ensures a high coefficient of boundary lubrication friction and an enhanced wear preventing property in a push belt-type continuously variable transmission.

BACKGROUND OF THE INVENTION

The push belt-type continuously variable transmission (which may be sometimes referred to as belt-type CVT hereinafter) rapidly increases in number because it is effective in improving a fuel cost and also drivability of automobiles. However, the belt-type CVT is difficult in obtaining a large transmission torque capacity, and has been mounted only on a small automobile whose displacement is 1600 cc or below. The improvement in the-transmission torque capacity is a serious problem on the belt-type CVT.

With the belt-type CVT, a torque is transmitted by means of a friction force between a belt element and a pulley. Thus, the transmission torque capacity is determined depending on the coefficient of friction between the metals of the belt element and the pulley and the urging force of the pulley. The coefficient of friction between the metals is influenced by the property of a lubricating oil. The shortage of the coefficient of friction between the metals may lead to the slippage between the belt and the pulley and may cause a disadvantage in that the belt is broken out.

On the other hand, an electromagnetic clutch has been hitherto used as a starting mechanism of the belt-type CVT. In order to cope with an increasing transmission torque accompanied by the tendency toward a great displacement and improve the drivability, there has been now used a wet clutch or and a torque converter with a lock-up clutch. These wet clutch, torque converter and CVT make use of a common lubricating oil. Accordingly, it has become important how to adapt the lubricating oil for continuously variable transmission (CVT oil) to the wet clutch or torque converter.

Under these circumstances, an automatic transmission oil (which may be referred to as ATF) has been frequently used for the CTV oil. This is because with an existing automobile of a small displacement, the transmission torque is so small that a required level of the coefficient of friction between metals is not so high, under which if an oil having a relatively high coefficient of friction between metals is selected among ATFs, the performance can be satisfied. The merit of making use of ATF includes actual results on the adaptability with a wet clutch and also on adaptability on other types of materials. However, if the belt-type CVT is mounted in an automobile of a large displacement, a required level of the coefficient of friction between metals increases. The mere use of ATF does not result in a satisfactory performance, and an oil only for the CVT has to be used.

Hitherto, lubricating oils for continuously variable transmission have been proposed including, for example, a lubricating oil composition of Japanese Patent Application Laid-open No. Hei 2-175794 wherein a wear preventive, a metal detergent and a carboxyl group-bearing friction modifier are formulated, a composition for continuously variable transmission of Japanese Patent Application Laid-open No. Hei 9-100487 wherein a sulfur-based extreme pressure agent, a phosphorus-based extreme pressure agent, and a metal-based detergent are formulated, a lubricating oil composition for continuously variable transmission of Japanese Patent Application Laid-open No. Hei 10-8081 wherein an ashless dispersant, a sulfur-based extreme pressure agent and a phosphorus-based extreme pressure agent are formulated, a lubricating oil composition for belt-type CVT automatic transmission of Japanese Patent Application Laid-open No. Hei 10-306292 wherein a Ca sulfonate and a phosphite ester having a specified range of a total base number are formulated, a lubricating oil composition for belt-type continuously variable transmission of Japanese Patent Application Laid-open No. Hei 11-80772 which has a coefficient of friction within a specified range and wherein a metal detergent and a zinc dialkyldithiophosphate are formulated, and a lubricating oil composition for continuously variable transmission of Japanese Patent Application Laid-open No. Hei 11-181464 wherein a polymethacrylate or the like, an imide compound and a zinc alkyldithiophosphate are formulated.

In spite of these proposals, however, there are few oils which provide an adequate, high level of a coefficient of friction between metals and an excellent oxidation stability. Especially, in order to obtain a required high coefficient of friction between metals, it is effective to formulate a combination of a wear preventive and a metal detergent in a belt-type continuously variable transmission lubricating oil (CVT oil). If it is intended to obtain a high coefficient of friction between metals only by use of the combination thereof, the amounts of a wear preventive and a metal detergent become too great, thus presenting the problem that oxidation stability becomes unsatisfactory, and thus, the transmission does not stand long-term use. Applicants' invention addresses these needs.

SUMMARY OF THE INVENTION

Applicants have found that when at least three additives including a wear preventive (A), a metal detergent (B) and an ashless dispersant (C) are formulates as essential components in a lubricating base oil, there is obtained a lubricating oil composition having a high coefficient of friction between metals required for a lubricating oil for continuously variable transmission and enhanced oxidation stability providing the performance over a long time.

More particularly, according to the invention, there is provided a lubricating oil composition for continuously variable transmission of the type which comprises a lubricating base oil made of a mineral oil and/or a synthetic oil formulated with a wear preventive (A), a metal detergent (B), and an ashless dispersant (C), characterized in that said ashless dispersant (C) consists of an succinimide having boron at a rate of one or more atoms in one molecule of the ashless dispersant.

As stated above, the invention relates to a lubricating oil composition wherein at least three specific types of compounds are formulated in a lubricating base oil. Preferred embodiments include those set forth below.

(1) A lubricating oil composition for continuously variable transmission, wherein the wear preventive is made of a phosphorus-based wear preventive.

(2) A lubricating oil composition for continuously variable transmission, wherein the phosphorus-based wear preventive is made of at least one phosphorus-based wear preventive selected from an acid phosphate ester, an acid phosphite ester and phosphoric acid and mixtures thereof.

(3) A lubricating oil composition for continuously variable transmission, wherein the phosphorus-based wear preventive is made of a zinc dialkyldithiophosphate whose alkyl groups are primary, secondary or a mixture thereof or a thiophosphate ester and mixtures thereof.

(4) A lubricating oil composition for continuously variable transmission, wherein the amount of the wear preventive ranges 200–500 ppm as phosphorus (P) based on the total weight of the composition.

(5) A lubricating oil composition for continuously variable transmission, wherein the amount of the metal detergent ranges 100–1000 ppm as a metal based on the total weight of the composition.

(6) A lubricating oil composition for continuously variable transmission, wherein the metal detergent has a total base number of 400 mg KOH/g or below.

(7) A lubricating oil composition for continuously variable transmission, wherein the metal detergent is made of an alkaline earth metal salt of an alkylbenzene or alkylnaphthalenesulfonic acid, an alkaline earth metal salt of an alkylphenol sulfide or an alkaline earth metal salt of an alkylsalicyclic acid and mixtures thereof.

(8) A lubricating oil composition for continuously variable transmission, wherein the ashless dispersant is made of a succinimide having boron at a rate of three or more atoms in one molecule of the ashless dispersant.

(9) A lubricating oil composition for continuously variable transmission, wherein the amount of the ashless dispersant ranges 0.1–10 wt % based on the total weight of the composition.

(10) A lubricating oil composition for continuously variable transmission, wherein the continuously variable transmission consists of a push belt-type continuously variable transmission.

The present invention may comprise, consist or consist essentially of the elements or steps herein and may be practiced in the absence of a limitation not disclosed as required; and includes the products produced by the processes disclosed herein.

DETAILED DESCRIPTION OF THE DETAILED EMBODIMENTS

The embodiments of the invention are described in more detail below.

Lubricating Base Oil

The base oil used in the lubricating oil composition for continuously variable transmission of the invention is not critical in type, for which any ones ordinarily used as a lubricating base oil may be employed. More particularly, oils falling under this category include mineral oils, synthetic oils or mixed oils thereof.

The base oil used in the practice of the invention should have a kinematic viscosity, at 100° C., ranging 0.5–200 $mm^2/s$, preferably 2–25 $mm^2/s$, and more preferably 3.5–8 $mm^2/s$. If the kinematic viscosity of the base oil is too high, the viscosity at a low temperature becomes poor. In contrast, when the kinematic viscosity is too low, there arise the problems that a wear may occur at a sliding portion of a continuously variable transmission and that a flash point becomes low.

The mineral oil consists of a hydrocarbon oil fraction having a lubricating oil viscosity. For example, there may be used a hydrocarbon oil, which is obtained by treating a vacuum distillate with an aromatic extraction solvent, such as phenol, furfural or N-methylpyrrolidone to obtain a raffinate, subsequently subjecting the raffinate to dewaxing with a solvent such as propane, methyl ethyl ketone or the like and, if necessary, further subjecting to hydro-refining to obtain a hydrocarbon oil, or a mixture of this hydrocarbon distillate oil with a residual oil obtained after the solvent extraction, dewaxing with a solvent and deasphalting with a solvent. From the standpoint of oxidation stability, it is preferred that the ratio of the aromatic carbon atoms to the total carbon atoms % $C_A$ (method of D3238 in ASTM) is 20 or below, more preferably 10 or below. From the standpoint of a pour point, the pour point should preferably be at −10° C. or below, more preferably at −15° C. or below. These refined mineral oils may be compositionally made of paraffin, naphthene and the like oils, and may be used singly or may be made of a mixed hydrocarbon thereof. Specific examples of the mineral oils include light neutral oils, medium neutral oils, heavy neutral oils and bright stocks, which are appropriately mixed so as to satisfy required properties, thereby preparing a base oil.

The synthetic oils used in the invention include olefin oligomers, dibasic acid esters, polyol esters, polyalkylene glycols, polyethers, alkylbenzenes, alkylnaphthalenes and the like.

The olefin oligomer is selected from those products that are obtained by homopolymerizing an arbitrary one selected from linear or branched olefins having 2–14 carbon atoms, preferably from 4–12 carbon atoms or by copolymerizing two or more olefins, with an average molecular weight raging 100–about 3,000, preferably 200–about 1,000. Preferably, those products wherein unsaturated bonds are removed through hydrogenation are preferred. Preferred examples of the olefin oligomer include polybutene, α-olefin oligomers, ethylene α-olefin oligomers and the like.

The dibasic acid esters include esters of aliphatic dibasic acids having 4–14 carbon atoms and aliphatic alcohols having 4–14 carbon atoms. The polyesters Include esters of polyhydric alcohols such as neopentyl glycol, trimethylolpropane, pentaerythritol and the like and aliphatic acids having 4–18 carbon atoms. In addition, esters of hydroxy acids such as hydroxypivalic acid, aliphatic acids and alcohols may also be used.

Examples of the polyoxyalkylene glycols include polymerized products of alkylene oxides having 2–4 carbon atoms. The alkylene oxides may be polymerized singly or in admixture thereof. The polymer of a mixture of alkylene oxides may be either a block polymer or a random polymer. The alkylene glycol may be blocked with an ether or ester at one or both ends thereof. Phenyl ether or the like may be used as the polyether.

These base oils may be used singly or in combination of two or more, and a mineral oil and a synthetic oil may be used in combination.

Additive Components

Next, the essential components (A)–(C) used in the lubricating oil composition of the invention are described.

The phosphorus-based wear preventive used as component (A) includes a phosphorus-based wear preventing agent such as phosphoric acid, phosphate esters, acid phosphate esters, thiophosphate esters (thiophosphate, dithiophosphate and the like), phosphite esters, acid phosphite esters, thiophosphite esters (trithiophosphite and the like), phosphonates, acid phosphonates, acid phosphate ester amine salts, acid phosphite ester amine salts, acid phosphonate amine salts or the like. It will be noted that in the phosphate or phosphite esters, sulfur (S) may be contained in the alkyl group. Alternatively, zinc dialkyldithiophosphates (ZnDTP) whose alkyl groups are primary, secondary or a mixture thereof may be used. Of these, acid phosphate esters, acid phosphite esters phosphoric acid: or mixtures thereof are preferably used. The amount of the wear preventive is generally within a range of 200–500 ppm as phosphorus (P) based on the total weight of the composition. If the amount I less than 200 ppm, the degree of improving the coefficient of friction between metals is small, with an unsatisfactory wear preventing property. On the other hand, when the amount exceeds 500 ppm, material adaptability deteriorates.

The metal detergent used as the component (B) in the lubricating oil composition of the invention includes salicylates, carboxylates, sulfonates, phenates or phosphonates that have an alkaline earth metal or an alkali metal in the molecule and are dissolved or uniformly dispersed in a lubricating base oil. Specific examples include alkaline earth metal salts of alkylsalicylic acids, alkaline earth metal salts of naphthenic acid or phthalic acid having a substituent such as an alkyl group, alkaline earth metal salts of petroleum sulfonic acid, alkylbenzenesulfonic acids or alkylnaphthalenesulfonic acids, alkaline earth metal salts alkylphenol sulfides or alkaline earth metal salts of thiophosphonic acid or phosphonic acid having a hydrocarbon group. Calcium (Ca) salts, magnesium (Mg) salts and barium (Ba) salts are favorably used. Alternatively, alkali metal: salicylates, carboxylates, sulfonates, phenates or phosphonates may also be used. Sodium (Na) or potassium (K) are used as the alkali metal. Of these, it is preferred from the standpoint of the effectiveness to use an alkaline earth metal salicylate or sulfonate.

These metal detergents should generally have a total base number (TBN) [JIS K2501 (perchloric acid method)] ranging 10–450 mg KOH/g, preferably 100–400 mg KOH/g. With respect to a soap content, those having a content of 20–50 wt %, preferably 30–45 wt %, are usable.

In the practice of the invention, the metal detergents may be used singly or in combination of two or more. The amount of the metal detergent is preferably in the range of 100–1000 ppm as a metal content based on the total weight of the composition. If the amount of a metal is less than 100 ppm, the action of improving the coefficient of friction between metals is not significant. On the other hand, when the content exceeds 1000 ppm, oxidation stability deteriorates.

On the other hand, when boron is present at rate of less than one atom in one molecule of ashless dispersant, a high coefficient of friction between metals can not be attained.

The boron-containing succinimide includes those obtained by treating a mono or bis product of succinimide with a boron compound. Preferably, a boron-containing product of a polyalkyl or polyalkenylsuccinimide is used.

The polyalkyl or polyalkenylsuccinimide can be usually prepared by reaction, with a polyalkylenepolyamide, of a polyalkyl or polyalkenylsuccinic acid anhydride obtained by reaction between a polyolefin and maleic anhydride. The mono and di products of the polyalkyl or polyalkenylsuccinimide can be prepared by changing the reaction ratio between the polyalkyl or polyalkenylsuccinic acid anhydride and the polyalkylenepolyamine. The polyolefin used as a starting material for the preparation of the polyalkyl or polyalkenylsuccinimide is appropriately selected those obtained by polymerizing α-olefins having approximately 2–8 carbon atoms. The α-olefins used for the formation of polyolefins may be uses singly or in combination of two or more. Polybutene is preferred as the polyolefin. On the other hand, mention is made, as a polyalkylenepolyamine, of polyethylenepolyamine, polypropylenepolyamine, polybutylenepolyamide and the like, for example. Of these, polyethylenepolyamide is preferred.

The product obtained by treating a polyalkyl or polyalkenylsuccinimide with boron used in the invention can be prepared in a usual manner. The content of boron in the boron-treated product usually ranges 0.1–5 wt %, preferably 1 wt % or over, based on the total weight of the boron-containing succinimide.

In the lubricating oil composition of the invention, the specific type of boron-containing succinimide used as the component (C) is usually contained in the range of 0.1–10 wt %, preferably 0.3–5 wt %, based on the total weight of the composition. If the amount of the boron-containing succinimide is less than 0.1 wt %, a desired effect is not satisfactorily shown. On the other hand, when the amount exceeds 10 wt %, the desired effect is not shown further more.

When the lubricating oil composition of the invention, which comprises these three types of additives as essential components, is employed as a lubricating oil for continuously variable transmission, such remarkable effects are achieved that a high coefficient of friction between metals and excellent oxidation stability for ensuring the performance over a long time, both required as a lubricating oil for continuously variable transmission, can be realized.

Other Additive Components

The lubricating oil composition of the invention comprises, as essential components, such compounds as set forth hereinabove formulated in a lubricating base oil. If necessary, various types of additives ordinarily used in ATF may be appropriately added to within ranges not impeding the purposes of the invention, including a friction modifier, an ashless dispersant, a metal deactivator, an antioxidant, a viscosity index improver, a pour point depressant, an antifoam agent, an antirusting agent, a colorant and the like.

As a friction modifier, there are conveniently used an amine friction modifier and a boron-containing friction modifier. Alternatively, amide compounds, imide compounds, boron-containing cyclic carboxylic acid imides and the like may be beneficially used. Examples of the amine friction modifier include alkylamines, alkyldiamines, dialkylamines or trialkylamines having 4–36 carbon atoms. Preferably, an alkylamine or a dialkylamine is used. For the boron-containing alcohol friction modifier, there are used aliphatic monoalcohols, aliphatic polyvalent alcohols or reaction products of alkylene glycols and boric acid. The amount of the friction modifier is preferably 0.01–5 wt % based on the total weight of the composition. If the amount is less than 0.01 wt %, a shudder-preventing property becomes insufficient. On the other hand, when the amount exceeds 5 wt %, the coefficient of friction between metals lowers.

The ashless dispersant includes imide compounds such as a monoimide, a bisimide and the like. These are used in an amount of 0.1–10 wt %.

The deactivator for metal includes benzotriazole, thiadiazole and derivatives thereof. The combination of compounds of the benzothiazole type and the thiadiazole type are preferred because of the remarkable improvement in oxidation stability caused by the combination. These are usually used in an amount of 0.001–3 wt %.

Preferred antioxidants include hindered phenols and amines. The use in combination of these is preferred because of the remarkable improvement in oxidation stability. Favorable phenolic antioxidants include 4-methyl-2,6-ditertiary butylphenol, 4,4-methylene-bis-2,6-ditertiary butylphenol and the like. The amine antioxidants include phenyl-a-naphthylamine, an alkylphenyl-a-diphenylamine, diphenylamine, an alkyldiphenylamine and the like. These are usually employed in an amount of 0.05–5 wt %.

A dispersion-type viscosity index improver can be favorably used as a viscosity index improver. Especially, a polyacrylate is preferred. More preferably, those containing about 5–20 mole % of a polar monomer are more preferred. As the polar monomer, there can be conveniently used amines such as diethylaminoethyl methacrylate, 2-methyl-5-vinylpyridine, and nitrogen-containing compounds such as N-vinylpyrrolidinone. With respect to the molecular weight of the dispersion-type viscosity index improver, those improvers having a number average molecular weight of 5,000–200,000 can be used, and the number average molecular weight of 100,000 or below is preferred from the standpoint of shear stability. The amount of the dispersion-type viscosity index improver is preferably within a range of 1–7 wt % based on the total weight of the composition. If the amount is less than 1%, the effect of improving oxidation stability is reduced. On the other hand, when the amount exceeds 7%, oxidation stability may deteriorate, instead. Other types of viscosity index improver may be used in combination. Usable viscosity index improvers include an olefin copolymer such as an ethylene-propylene copolymer or the like, a polyacrylate, a polymethacrylate or the like. In view of its low temperature viscosity, a polymethacrylate is preferably used. These are usually used in an amount of 1–20 wt %.

The pour point depressant usually includes an ethylene-vinyl acetate copolymer, a condensate of chlorinated paraffin and naphthalene, a condensate of chlorinated paraffin and phenol, a polymethacrylate, a polyalkylstyrene or the like. These are generally used in an amount of 0.01–5 wt %.

An antifoam agent includes a silicone compound such as dimethylpolysiloxane or the like, sorbitan monolaurate, or an ester compound such as an alkenylsuccinic acid derivative. These are usually used in an amount of 0.0001–2 wt %.

Further, a corrosion inhibitor, a colorant and the like additives may be used in the lubricating oil composition of the invention, if desired.

Examples of the belt-type CVT useful in the present invention include a CVT using a metallic belt manufactured by Van Doome' Transmissie BV Corp. In the practice of the invention, the belt-type CVT is not limited to a CVT using the belt manufactured by Van Doorne' Transmissie BV Corp., and the composition can be applied to a similar mechanism, i.e. a CVT capable of transmitting power by use of friction between metals. Because the lubricating oil composition of the invention can be expected to keep a high coefficient of friction between metals over a long time, it exhibits a good performance against an ordinary belt-type CVT and can be conveniently used as a belt-type CVT oil. Moreover, the composition can be suitably used as an ordinary automatic transmission (ATF) oil.

EXAMPLES

The invention is described in more detail by way of examples and comparative examples. The invention should not be construed as limiting to these examples. It will be noted that the method of measuring a coefficient of friction between metals and a method for evaluating oxidation stability in examples and comparative example were conducted in the following manner.

(1) COEFFICIENT OF FRICTION BETWEEN METALS

An SRV friction testing machine (reciprocating friction testing machine) was used as a testing machine, and the test was conducted under the following conditions to measure an initial coefficient of friction between metals (i.e. a maximum value of a coefficient of friction between metals immediately after commencement of sliding). A sample having a coefficient of friction between metals of 0.16 or over was judged as acceptable.

Test Conditions

Test piece: ball (SUJ2), plate (SUJ2)

Test temperature: 100° C.

Load: 100 N

Frequency: 50 Hz

Stroke: 1 mm

(2) OXIDATION STABILITY

The oxidation stability was accorded to a testing method of oxidation stability of a lubricating oil for internal combustion engine (ISOT) of JIS K2514 as an evaluation test, in which a sample oil was tested under test conditions of an oil temperature of 165° C. and a test time of 192 hours to measure an increment of a total acid number prior to and after oxidation and a pentane insoluble matter of the sample oil after oxidation. A sample oil having an increment of the total acid number of 1 mg KOH/g or below was judged as acceptable.

(3) EXAMPLES AND COMPARATIVE EXAMPLES

Example 1

A solvent-refined paraffin mineral oil (having a kinematic viscosity of 4 $mm^2/s$ at 100° C. ) was used as a base oil. The base oil was formulated, based on the total weight of a composition, with a phosphorus-based wear preventive of component (A) used in an amount of 350 ppm as P, Ca salicylate of component (B) in an amount of 350 ppm, and boron-containing succinimide of component (C) having 7.1 boron atoms in one molecule of the dispersant and used in an amount of 1.0 wt %, along with 10.0 wt %, in total, of other additives including an antioxidant, a viscosity index improver, a metal deactivator and an antifoam agent, each in a given amount, thereby preparing a lubricating oil composition.

The phosphorus-based wear preventive of component (A) is made of a mixture of a monoalkyl acid phosphate and a dialkyl acid phosphate wherein individual alkyl groups have 4 carbon atoms.

The Ca salicylate of component (B) has a total base number of 170 mg KOH/g. The boron-containing succinimide of component (C) is a boron-containing polybutenylsuccinimide having a molecular weight (MW) of 1600 wherein boron is contained at a rate of 7.1 atoms in one molecule of the ashless dispersant (i.e. boron-containing succinimide).

The thus prepared lubricating oil composition was subjected to measurement of a coefficient of friction between metals and evaluation of oxidation stability. The results are shown in Table 1. The coefficient of friction between metals in Example 1 was found to be 0.175, and the oxidation stability was so good that an increment of total acid number was at 0.0 mg KOH/g and a pentane insoluble matter was at 0.0 wt %.

Examples 2, 3

Similar to Example 1, the base oil component and additive components indicated in Table 1 were formulated at such ratios as indicated in the table to prepare lubricating oil compositions. The thus prepared lubricating oil compositions were each subject to measurement of a coefficient of friction between metals and also to evaluation on stability. These results are shown in Table 1. Like Example 1, the results of the evaluation in Examples 2, 3 were good.

Comparative Examples 1–3

The lubricating base oil component and various types of additive components indicated in Table 1 were, respectively, formulated at such ratios indicated in the table, thereby preparing lubricating oil compositions. The thus prepared lubricating oil compositions were, respectively, subjected to measurement of a coefficient of friction between metals and also to evaluation of oxidation stability. The results are shown in Table 1.

TABLE 1

| | Example 1 | Example 2 | Example 3 | Comp. Ex. 1 | Comp. Ex. 2 | Comp. Ex. 3 |
|---|---|---|---|---|---|---|
| Composition | | | | | | |
| Base oil *1 | Balance | Balance | Balance | Balance | Balance | Balance |
| (A) Phosphorus-based wear preventive *2 Amount of P (ppm) | 350 | 350 | 350 | 350 | 500 | 350 |
| (B) Ca salicylate *3 amount of Ca (ppm) | 500 | 500 | — | 500 | 1200 | — |
| Ca sulfonate *4 amount of Ca (ppm) | — | — | 500 | — | — | 500 |
| (C) Boron-containing succinimide *5 (wt %) | 1.0 | — | — | — | — | — |
| Boron-containing succinimide *6 (wt %) | — | 1.0 | — | — | — | — |
| Boron-containing succinimide *7 (wt %) | — | — | 1.0 | — | — | — |
| Boron-containing succinimide *8 (wt %) | — | — | — | 1.0 | — | — |
| Succinimide *9 (wt %) | — | — | — | — | — | 1.0 |
| Boron atoms in one molecule of ashless dispersant | 7.1 | 5.1 | 1.2 | 0.9 | — | 0 |
| Other additives *10 (wt %) | 10.0 | 10.0 | 10.0 | 10.0 | 10.0 | 10.0 |
| Coefficient of friction between metals | 0.175 | 0.173 | 0.164 | 0.154 | 0.170 | 0.155 |
| Oxidation stability (ISOT) @165° C., 192 hours | | | | | | |
| Increment of total acid number (mg KOH/g) | 0.0 | 0.0 | 0.1 | 0.1 | 3.5 | 0.1 |
| Pentane insoluble matter (wt %) | 0.0 | 0.0 | 0.0 | 0.0 | 0.8 | 0.0 |

*1: Solvent-refined paraffin mineral oil (kinematic viscosity of 4 $mm^2/s$ at 100° C.)
*2: (monoalkyl/dialkyl mixed) acid phosphate
*3: Ca alkylbenzenesalicylate with a total base value of 170 mg KOH/g
*4: Ca alkylbenzenesulfonate with a total base value of 300 mg KOH/g
*5: Ashless dispersant having an average molecular weight of 1600 and 7.1 boron atoms in one molecule thereof.
*6: Ashless dispersant having an average molecular weight of 1700 and 5.1 boron atoms in one molecule thereof.
*7: Ashless dispersant having an average molecular weight of 1800 and 1.2 boron atoms in one molecule thereof.
*8: Ashless dispersant having an average molecular weight of 1400 and 0.9 boron atoms in one molecule thereof.
*9: Ashless dispersant having an average molecular weight of 1400 with the number of boron atoms being zero in one molecule thereof (boron atom not contained).
*10: Antioxidant, viscosity index improver, metal deactivator, and antifoam agent added to as other additives, each in a given amount In view of the examples and comparative examples, it will be apparent that when three essential additives including wear preventive (A), metal detergent (B), and a specific type of ashless dispersant (C), i.e. a boron-containing succinimide having boron at a rate of one or more atoms in one molecule of the ashless dispersant, are formulated in specified amounts, respectively, the purpose for a lubricating oil is satisfied and a high-quality oil can be obtained.

On the other hand, in Comparative Example 1 wherein although the wear preventive of component (A) and the metal detergent of component (B) are formulated, a boron-containing succinimide having boron at a rate of less than one atom in one molecule of the ashless dispersant and thus not corresponding to component (C) is formulated, the coefficient of friction between metals is low. In Comparative Example 2 wherein any boron-containing succinimide of component (C) is not formulated, oxidation stability deteriorates although the coefficient of friction between metals is high. In Comparative Example 3 wherein a succinimide having no boron therein is formulated in place of the boron-containing succinimide of component (C), the coefficient of friction between metals is low.

The lubricating oil composition for continuously variable transmission of the invention, particularly, the lubricating oil composition for push belt-type continuously variable transmission comprises specific three types of additives, i.e. wear preventive (A), metal detergent (B) and ashless dispersant (C), formulated in a lubricating base oil, wherein said ashless dispersant is made of a boron-containing succinimide having boron at a rate of one or more atoms in one molecule of the ashless dispersant whereby the composition ensures such excellent properties that both a high coefficient of friction between metals and excellent oxidation stability guaranteeing performance over a long time stand together.

What is claimed is:

1. A lubricating oil composition for continuously variable transmission of the type which comprises a lubricating base oil made of a mineral oil and/or a synthetic oil formulated with a wear preventive, a metal detergent and an ashless dispersant characterized in that said ashless dispersant consists of an succinimide having boron at a rate of three or more atoms in one molecule of the ashless dispersant.

2. The composition of claim 1 wherein the wear preventive is a phosphorous-based wear preventive selected from an acid phosphate ester, an acid phosphite ester and phosphoric acid and mixtures thereof.

3. The composition of claim 1 wherein the base oil has a kinematic viscosity of 0.5–20 $mm^2$/sec.

4. The composition of claim 1 wherein the metal detergent has a total base number of not greater than 400 mg KOH/g.

5. A method for enhancing wear prevention in a continuously variable transmission by providing thereto a lubricating oil composition comprising a lubricating base oil formulated with a wear preventive, a metal detergent and an ashless dispersant characterized in that said ashless dispersant consists of an succinimide having boron at a rate of three or more atoms in one molecule of the ashless dispersant.

* * * * *